United States Patent [19]

Simmons

[11] 3,935,616

[45] Feb. 3, 1976

[54] SEALLESS STRAP CONNECTION MEANS

[75] Inventor: Larry J. Simmons, Northbrook, Ill.

[73] Assignee: Signode Corporation, Glenview, Ill.

[22] Filed: Jan. 24, 1975

[21] Appl. No.: 543,999

[52] U.S. Cl. ..... 24/20 EE

[51] Int. Cl.² ..... B65D 63/02

[58] Field of Search ..... 24/20 R, 20 EE, 23 EE

[56] References Cited

UNITED STATES PATENTS

| | | | |
|---|---|---|---|
| 180,910 | 8/1876 | Olmsted | 24/20 EE |
| 1,606,331 | 11/1926 | Anderson | 24/20 EE |
| 2,268,339 | 12/1941 | Leslie | 24/20 EE |
| 2,276,988 | 3/1942 | Leslie | 24/20 EE |
| 3,137,047 | 6/1944 | Mosey | 24/20 EE |
| 3,177,538 | 4/1965 | Timmerbeil | 24/20 EE |
| 3,188,706 | 6/1965 | Partridge | 24/20 EE |
| 3,303,541 | 2/1967 | Beach | 24/20 EE |
| 3,426,392 | 2/1969 | Timmerbeil | 24/20 EE |
| 3,457,599 | 7/1969 | Timmerbeil et al. | 24/20 EE |

FOREIGN PATENTS OR APPLICATIONS

| | | | |
|---|---|---|---|
| 1,498,090 | 9/1967 | France | 24/20 EE |

*Primary Examiner*—Donald A. Griffin

*Attorney, Agent, or Firm*—Dressler, Goldsmith, Clement & Gordon, Ltd.

[57] ABSTRACT

Overlapping ends of metal strap or the like are connected without the aid of an overlying supplemental seal or fastener by means of longitudinally spaced joints which form a one way interlocking relationship. An integral abutment means comprises juxtaposed protuberances, integral with the overlapping strap segments, which irreversibly override each other as the interlocking relationship is formed and present spaced stops which abut each other before a formed interlock can disengage when the overlapping strap segments are shifted relative to each other in an interlock disengaging direction.

8 Claims, 10 Drawing Figures

SEALLESS STRAP CONNECTION MEANS

BACKGROUND OF THE INVENTION

This invention relates to sealless joints or splices in strap made of relatively stiff sheet material, i.e., metal strap and the like.

It is known to provide sealless connections between strap ends in the form of an array of longitudinally spaced joints. A very common form of such a joint utilizes a central tongue provided with lateral wing extensions partly along the opposite edges of the tongue. However, the load handling strength of such a connection is reduced because the width of the wing extensions reduces the effective cross section of the strap.

Variations of the aforementioned double wing tongue joint have been suggested over the years. Representative prior art patents in this particular field of art are U.S. Pat. No. 180,910 to Olmsted, U.S. Pat. No. 1,606,331 to Anderson, U.S. Pat. Nos. 2,268,339 and 2,276,988 to Leslie, U.S. Pat. No. 3,137,047 to Mosey, U.S. Pat. No. 3,177,538 to Timmerbeil, and U.S. Pat. No. 3,188,706 to Partridge. Yet in all of the foregoing variations, the effective cross-sectional area of the strap is considerably reduced at the connection, thereby reducing the tensile strength of the connected strap. A sealless connection wherein a relatively higher strength at the connection is realized and lateral pull out action is avoided or minimized is taught in U.S. Pat. No. 3,303,541 to Beach.

In all but one of the aforesaid instances the connection is maintained only while the joined overlapping ends are kept under tension. When tension is temporarily released on the connection, or when the overlapping strap ends are longitudinally shifted relative to each other as someone bumps against the strap connections formed around a temporarily compressed bundle of material which is in the process of being strapped, i.e., a bale of cotton or the like, the connections will release and the joined strap ends will again separate.

In the aforementioned U.S. Pat. No. 3,188,706 to Partridge there is disclosed a means to lock a produced one way tension connection by embossing internested dimples in the overlapped connected strap segments. However, a special tool is required for this purpose, thus the proposed locking means is cumbersome to use. Where a large number of workers performs strapping operations at about the same time, a sizeable investment in special tools must be made. Moreover, unless the embossing is done with care, camming surfaces are formed around the periphery of the embossments which camming surfaces tend to spread the internested dimples apart when the strap segments are subjected to a lengthwise force, i.e., by dropping or subsequent compression of a tied bundle. This action by the camming surfaces will tend to defeat the desired locking action when the lengthwise force is a compressive force, and may promote tearing of the interlocking joints in instances where the connected strap is overtensioned. The fastenerless splice of U.S. Pat. No. 3,188,706 also is cumbersome to form because a two-step operation is needed, i.e., the joints must first be made to interlock and then the internested dimples have to be formed.

The present invention, on the other hand, contemplates a sealless strap connection having an integral locking means which obviates the aforementioned drawbacks and which does not require any tools for affixation.

SUMMARY OF THE INVENTION

The present invention contemplates an array of longitudinally spaced joints, formed by overlapping strap segments and connecting a pair of strap ends against pull out, in combination with an integral abutment means which retains the longitudinally spaced joints in an interlocked position once the joints are formed.

The integral abutment means is positioned between a pair of longitudinally spaced joints. Each joint comprises lengthwise opposed shoulders which are displaced from the respective planes of the overlapped strap lengths or segments. The lengthwise opposed shoulders are defined by a pair of juxtaposed, staggered slits in the overlapping strap segments and are shaped so as to interlock with each other. The abutment means comprises juxtaposed protuberances shaped so as to irreversibly override each other while the opposed shoulders are moved to an interlocking position and to present opposing stops when joint-forming opposed shoulders are interlocked with each other.

In a preferred embodiment, for each joint each transverse section of each of the overlapping strap segments forming the sealless connection is provided with a single staggered slit defined and flanked by complementary integral strap web portions that are offset in opposite directions normal to the plane of the strap segments. The strap web portions form opposed shoulders so that juxtaposed strap web portions on one strap segment provide lengthwise aligned shoulders matched to corresponding shoulders on the other strap segment. In overlapping strap segments, the inner opposed shoulders of each strap web portion interlock along the staggered slits when the overlapping strap segments are shifted longitudinally. The integral abutment means is substantially centered on each of the overlapping strap segments and is positioned between a pair of the spaced joints. The abutment means can be a protuberance defined by a substantially transverse slit in each of the overlapping strap segments and positioned so that opposing protuberances of the overlapping strap segments abut each other when the overlapping strap segments are shifted longitudinally in a direction tending to disengage the interlocked shoulders.

BRIEF DESCRIPTION OF THE DRAWINGS

In the accompanying drawings which illustrate embodiments of the present invention.

DESCRIPTION OF THE PREFERRED EMBODIMENTS

Figures 1, 2, 3, 4, 5:
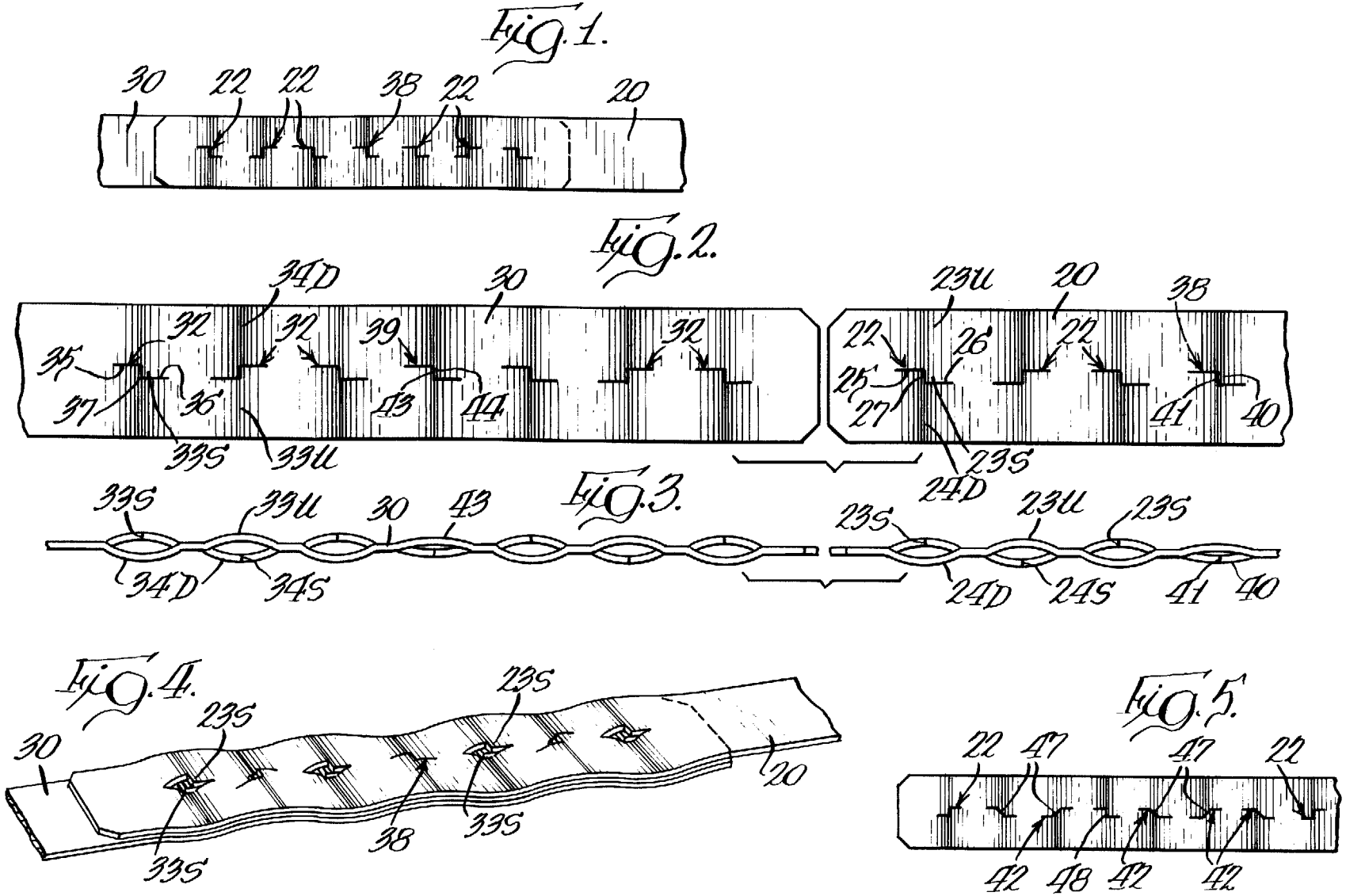
FIG. 1 is a fragmentary plan view of overlapping lengths of strap nested in full registry in preparation for offset movement into an interlocking relationship.
FIG. 2 is an enlarged fragmentary plan view of the strap ends of FIG. 1 before nesting of the same.
FIG. 3 is a side elevational view of the strap ends pictured in FIG. 2.
FIG. 4 is a fragmentary perspective view of portions of the strap lengths pictured in FIG. 1 and showing the same interlocked.
FIG. 5 is a fragmentary plan view of one strap end in accordance with an alternative embodiment of the invention.

Referring now to the drawings, upper and lower overlapped lengths of metal strap 20 and 30, respectively, are shown for tension transmitting inter-engagement by means of a sealless strap connection defined therebetween. Such sealless strap connections usually include a tandem array of longitudinally spaced shear lock joints, six of which are shown in FIG. 1 in combination with one integral abutment means. The particular sections of strap which overlap and interlock to make up each joint are configured to nest substantially fully to enable the overlapping lengths 20 and 30 to engage in substantially full surfaced contact. In a six joint connection array, each strap length has six such nestable sections. The integral abutment means can be positioned between any two joints formed by slits 22 and 32, or the abutment means can be positioned symmetrically, having an equal number of joints on each side, as desired.

Each of the nestable strap sections of the upper strap 20, as best seen in FIGS. 2 and 3, characterized by a lengthwise directed staggered slit 22 defining and flanked by complementary strap web portions 23U and 24D that integrally merge endwise with full body regions of the strap and that are offset in opposite normal directions from the plane of the strap. The web portions 23U are offset upwardly and each presents a shoulder 23S and the web portions 24D are offset downwardly and each presents a shoulder 24S. Thus, the shoulders 23S and 24S are lengthwise aligned but offset in a direction normal to the plane of the strap. Each staggered slit 22 has lengthwise directed end regions 25, 26 bridged by an intermediate or lateral jog region 27.

Correspondingly, each of the nestable strap sections of the lower strap 30 is characterized by a substantially identical lengthwise directed slit 32 defining and flanked by complementary strap web portions 33U and 34D presenting shoulders 33S and 34S, respectively, that are normal to the plane of the strap. Each staggered slit 32 has lengthwise directed end regions 35, 36 bridged by an intermediate lateral jog region 37.

Strap length 20 is also provided with downwardly extending protuberance 40 defined by the transverse central region of Z-shaped slit 38. Strap length 30 is similarly provided with upwardly extending protuberance 43 defined by the transverse central region of Z-shaped slit 39. When strap lengths or segments 20 and 30 are superimposed in full registry as shown in FIG. 1, staggered slits 22 and 32 are in juxtaposition and shoulders 23S nest with shoulders 33S. Likewise, protuberance 40 is in juxtaposition with protuberance 43. In this position and considering the completed joint shown at the extreme left in FIG. 4, each nestable strap section of such joint presents a locking shoulder 24S and 33S that nests in the jog region of the slit in the other section. Thus, shoulder 24S nests in the jog region 37 in preparation for endwise entry into slit end region 36 and shoulder 33S nests in the jog region 27 in preparation for entry into the slit end region 25. Thereafter the strap lengths 20 and 30 are shifted longitudinally to effect one way mutual interlocking relationship between the shoulders 33S and 24S and slit end regions 25 and 36, respectively.

Upon shifting of the overlapped strap segments 20 and 30 longitudinally away from each other, shoulders 33S interlock with underlying shoulders 24S and protuberances 40 and 43 override each other and click in place so that stop 41 faces stop 44. Before tension is applied to the strap, the connection has a small amount of play. The resulting connection of strap ends assumes the configuration shown in FIG. 4. In this configuration stop 41 is spaced from stop 44 so that the individual making the connection can utilize the existing play to check whether the strap segments have been secured by simply longitudinally pushing the connected strap towards each other, i.e., by shifting the strap segments relative to each other so that interlocking shoulders 24S and 33S are moved toward their respective nesting positions with shoulders 34S and 23S. If the connection is secure, stops 41 and 44 of opposing protuberances 40 and 43 will abut each other audibly before the nesting positions are reached, thereby preventing further longitudinal shifting of strap segments 20 and 30 and the attendant disengagement of interlocked shoulders 33S and 24S.

The slit configuration defining the abutment means is not overly critical. A straight, substantially transversely extending slit can be used, or a Z-shaped or staggered slit, as well as a square notch as will be discussed in greater detail hereinbelow. For ease of manufacture and extended cutting die life, it is preferable to cut a Z-shaped or staggered slit the central region of which defines the protuberances as well as the abutting surfaces thereof.

In the embodiment disclosed in FIGS. 1 to 4, the lateral jog regions of the staggered slits 22 and 32 are essentially transverse and correspondingly the interlocking shoulders are right angled. These interlocking shoulders create an essentially lengthwise directed reaction effect free of lateral wedging effects.

The staggered slits can be centered and aligned, or can be arrayed in a balanced offset pattern, as desired. Certain of the slits jog in one lateral direction and the others jog in an opposite lateral direction. A staggered slit is here said to be centered when the midpoint of the lateral jog region is approximately on the strap centerline. For this condition the flanking strap web portions are equal in effective cross section and the forces transmitted by the strap balance out about the fulcrum point established by the interlocking shoulder, thus avoiding strap twisting effect.

When the strap joints are stressed to failure, the failure may be of the break type or the lateral pull out type. In the disclosed configuration, the connections produced when the stamping die is new and wear free are arranged to provide a break type failure. Upon wear of the tool, the slit configuration varies slightly particularly at the jog region and the connections then produced give the lateral pull out type of failure and actually achieve greater failure strength. Continued wear of the tool, thereafter, leads to weaker joints.

It should be noted that each of the slits 22, 32 may be provided with a straight companion slit to provide a laterally facing abutment for preventing lateral pull out movement; however, with the centered, right-angled slit configuration these companion slits are not required. Such companion slits can be used where the staggered slits are off the strap centerline.

An alternative slit configuration for use in a sealless strap connection is illustrated in FIG. 5 wherein one strap end is shown having staggered right angle slits 22 at opposite ends and having intermediate staggered slits 42 having angled jog regions 47. The integral abutment means for this strap end is provided by staggered slit 48 in the same manner as discussed above for staggered slits 38 and 39.

In a particular embodiment, the sealless joints are provided in heat treated strap that is ¾ inch by 0.025 inch. A total of six joints and one integral locking abutment means are provided, and the offset dimension for each staggered slit is about 10 percent of the strap width. Each joint region is therefore about 90 percent as strong as the strap. Where each slit is of the same offset dimension, ultimate failure occurs at the end slit. The produced joints cannot be disengaged because of the action of the locking abutment means. The effective combined strength of the joint can be increased somewhat by utilizing end slits of slightly less offset dimension than that of the intermediate slits.

Figures 6A, 6B, 6C, 6D, 7:
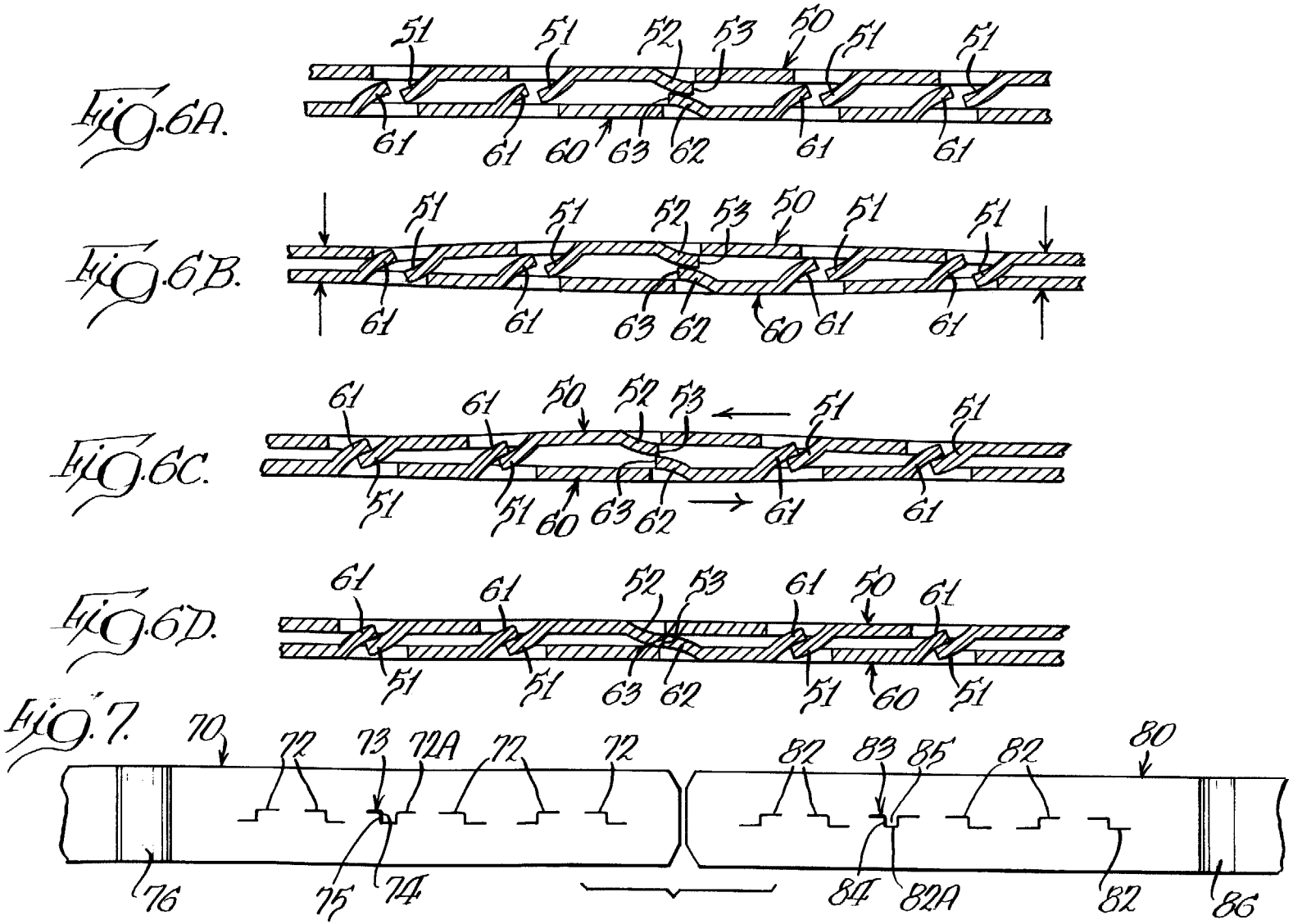
FIGS. 6A through 6D are sequential sectional elevations on an enlarged scale and illustrating the action of the locking abutment means of the present invention.
FIG. 7 illustrates yet another embodiment of this invention.

Operation of the integral abutment means is illustrated in FIGS. 6A through 6D. Metal strap segments 50 and 60 are provided with respective shoulders 51 and 61 which are displaced from the respective planes of strap segments 50 and 60 and with integral protuberances 52 and 62 having abutment surfaces or stops 53 and 63, respectively. When strap segments 50 and 60 are first overlapped as shown in FIG. 6A, shoulders 51 and 61 oppose with each other and protuberances 52 and 62 are juxtaposed. Next, as indicated by the solid vertical arrows in FIG. 6B, strap segments 50 and 60 are pressed together on both sides of juxtaposed protuberances 52 and 62. Due to the springiness or elasticity of metal strap segments 50 and 60, these segments are bowed slightly outwardly in the region of the protuberances.

Thereafter, strap segments 50 and 60 are shifted longitudinally in the direction indicated by solid horizontal arrows in FIG. 6C so that lengthwise opposed shoulders 51 and 61 begin to engage each other, and juxtaposed protuberances 52 and 62 follow an irreversible path overriding each other and clicking in place due to the inherent spring action of the bowed strap sections integral with the protuberances as shown in FIG. 6D. In this manner a sealless connection having a plurality interlocking shoulders 51 and 61 is formed with protuberances 52 and 62 presenting opposed abutment surfaces or stops 53 and 63. As tension is applied to the formed connection, the connection is maintained by interlocking shoulder 51 and 61 which continue to be wedged against each other while stops 53 and 63 are spaced from each other. On the other hand, in the event tension is temporarily released and/or overlapping strap lengths or segments are longitudinally shifted relative to each other in a direction tending to disengage shoulders 51 from shoulders 61, stops 53 and 63 abut each other, thereby preventing further movement before disengagement of the interlocking shoulders can occur.

The integral abutting protuberances can be individually formed in the overlapping strap segments as discussed hereinabove or the protuberances can be formed in the distal end regions of staggered slits defining nesting shoulders as illustrated in FIG. 7. Strap segments 70 and 80, adapted for overlapping engagement and having respective staggered slits 72 and 82 defining interlocking shoulders as described hereinabove, are additionally provided at the distal end regions of staggered slits 72A and 82A with square notches 73 and 83, respectively, which notches define integral protuberances having abutting surfaces or stops 74 and 84. Web portion 75 having stop 74 is slightly raised above the plane of strap segment 70 and tang 85 integral with strap segment 80 is slightly depressed out of the plane of strap segment 80 so that stops 74 and 84 oppose each other when interlocking joints are formed. As before, stops 74 and 84 are spaced from each other when the produced connection is under tension but abut each other when tension is temporarily released or when the strap segments are manually shifted in a lengthwise direction to test the connection. If desired, transverse indentations 76 and 86 can be provided in strap segments 70 and 80, respectively, to assist in properly locating these segments when the sealless connection is about to be formed. As shown in FIG. 7, indentation 76 is convex and indentation 86 is concave; however, any other arrangement of these indentations may be utilized as a locating aid.

The foregoing description and the drawings are intended as illustrative and are not to be taken as limiting. Still other variations and/or rearrangements of parts within the spirit and scope of the present invention are possible and will readily present themselves to the skilled artisan.

I claim:

1. A sealless strap connection between overlapped lengths of strap which comprises an array of longitudinally spaced joints and an integral abutment means positioned between a pair of said joints, each joint comprising lengthwise opposed shoulders displaced from the respective planes of said overlapped lengths of strap and shaped to interlock with each other, and said abutment means comprising juxtaposed protuberances shaped to irreversibly override each other while said opposed shoulders are moved into an interlocking position and presenting opposed stops when said shoulders interlock with each other.

2. The sealless strap connection in accordance with claim 1 wherein said lengthwise opposed shoulders are defined by a pair of juxtaposed, staggered slits in said overlapping lengths of strap and said stops abut each other before disengagement of interlocked shoulders takes place when said overlapped lengths of strap are shifted lengthwise in an interlock disengaging direction.

3. The sealless strap connection in accordance with claim 1 wherein said protuberances are defined by substantially transverse slits in the respective lengths of strap.

4. The sealless strap connection in accordance with claim 3 wherein each protuberance is defined by a substantially Z-shaped slit having a substantially transverse central region.

5. In a sealless strap connection between overlapped lengths of metal strap, an array of longitudinally spaced shear lock joints, each joint being defined between nestable strap sections provided by matched integral portions of each length of metal strap, said nestable strap sections that defined each joint being partly offset longitudinally to engage in one way mutually interlocking relationship, each said nestable strap section having a single longitudinally oriented staggered slit comprised of lengthwise slit end regions and a lateral job region joining the slit end regions, each staggered slit defining and being flanked by complementary integral strap web portions offset in opposite normal directions to present lengthwise opposed shoulders bordering the intermediate jog region of the slit, each joint having each of its nestable strap sections presenting a locking shoulder nestable within the jog region of the other strap section and enterable endwise into the opposing slit end region of said other section to establish one way interlocking engagement therebetween, and an integral abutment means situated between a pair of said shear lock joints and comprising an opposing protuberance in each overlapping length of metal strap and arranged so that upon shifting of the joined overlapping lengths of metal strap in a direction to disengage said interlocking engagement said protuberances abut each other before disengagement occurs.

6. The sealless strap connection in accordance with claim 5 wherein at least two of said joints have locking shoulders of substantially right-angled configuration and wherein said protuberances have abutting surfaces substantially parallel to the transverse edges of said locking shoulders.

7. The sealless strap connection in accordance with claim 5 wherein said protuberances are defined by a substantially square notch at the distal end regions of an opposed pair of longitudinally oriented staggered slits.

8. A strap segment applied for forming a sealless strap connection between overlapped lengths of strap which segment, at each terminal portion of said strap segment, comprises an array of longitudinally spaced joint elements and an integral abutment element means positioned between a pair of said joint elements, each joint element comprising a lengthwise shoulder displaced from the plane of the strap segment and shaped to interlock with a superposed joint element, and said abutment element means comprising a protuberance shaped to irreversibly override a superposed protuberance while one of said shoulders is moved into an interlocking position with another shoulder of a superposed joint element and together with said superposed protuberance presenting opposed stops when said shoulders interlock with each other.

* * * * *